United States Patent [19]

Springer et al.

[11] Patent Number: 5,004,523

[45] Date of Patent: Apr. 2, 1991

[54] DELIGNIFICATION OF LIGNOCELLULOSIC MATERIALS WITH MONOPEROXYSULFURIC ACID

[75] Inventors: Edward L. Springer, Madison; James L. Minor, Middleton, both of Wis.

[73] Assignee: The United States of America as represented by the Secretary of Agriculture, Washington, D.C.

[21] Appl. No.: 330,547

[22] Filed: Mar. 30, 1989

[51] Int. Cl.[5] ..... D21C 3/04

[52] U.S. Cl. ..... 162/76; 162/78; 426/635; 426/636

[58] Field of Search ..... 162/78, 76, 19, 90; 8/110, 111; 426/635, 636, 807

[56] References Cited

U.S. PATENT DOCUMENTS 2,739,034 3/1956 Fell ..... 8/110

4,404,061 9/1983 Cael .

4,475,984 10/1984 Cael .

OTHER PUBLICATIONS

Khim. Drev. (Riga) 9: 109–117 (1971), Zakis, in English (Translation).

Roger G. Bates, *Determination of pH*, Theory and Practice, pp. 18–19, 1964, John Wiley and Sons, Inc.

*Primary Examiner*—Steve Alvo

*Attorney, Agent, or Firm*—M. Howard Silverstein; William J. Connors

[57] ABSTRACT

A method for the delignification of lignocellulosic materials with acidic aqueous solutions of monoperoxysulfuric acid for the production of cellulosic pulps for use in papermaking and regenerated cellulose products and for use as animal feeds and other products where removal of lignin is required.

2 Claims, 3 Drawing Sheets

DELIGNIFICATION OF LIGNOCELLULOSIC MATERIALS WITH MONOPEROXYSULFURIC ACID

BACKGROUND OF THE INVENTION

This invention describes a new and useful method for removing lignin from lignocellulosics to produce cellulosic pulps for use in papermaking, bleached pulps, regenerated cellulosic products and pulps having increased food value due to greater carbohydrate digestibility as a result of lignin removal from a lignocellulosic material and any other product in which the removal of lignin from a lignocellulosic is beneficial.

Treatment of lignocellulosics with monoperoxysulfuric acid ($H_2SO_5$) and its salts has been described in U.S. Pat. Nos., 4,404,061 and 4,475,984. The claims of the former patent are focused on bleaching of pulps and the latter on a pretreatment of wood chips prior to alkaline pulping. Delignification of wood or other lignocellulosics with monoperoxysulfuric acid or its salts is not disclosed or claimed.

In both U.S. patents, a preferred pH range of 3.0–12.0 is disclosed, the pH being adjusted by addition of alkali or acid to the monoperoxysulfuric acid solution. A pH range of 2.0–12.0 is claimed. For bleaching, the amount of monoperoxysulfuric acid on oven dried pulp is given as being in the range of 0.5–5% as $KHSO_5$ at 10% consistency. Under these conditions the weight percent of monoperoxysulfate anion is 0.04–0.4% of the weight of bleach liquor.

The use of monoperoxysulfuric acid as a pretreatment for alkaline pulping in U.S. Pat. No. 4,475,984 reports a $KHSO_5$ range of 0.35–35% weight based on the weight of wood chips. At the 7.6 to 1 liquor to wood ratio disclosed in the Patent, the weight percent of monoperoxysulfate anion is 0.034–3.4% of the pretreatment liquor.

In Khim. Drev. (Riga) 9: 109–117 (1971) monoperoxysulfuric acid (Caros acid) in concentrated sulfuric acid (20–50% is used to effectively delignify spruce wood both in terms of yield of cellulose residue and quantity of lignin removed. Examining the data from this publication one sees the preferred condition is 20–50 percent sulfuric acid, and 0.2 grams active oxygen per gram of wood, the active oxygen being one of the oxygen atoms in the monoperoxysulfuric acid molecule. It was noted that detectable concentrations of $H_2SO_5$ were present only when sulfuric acid concentrations were greater than 20% in the system sulfuric acid, ammonium persulphate. Twenty percent sulfuric acid corresponded to the lowest concentration at which delignification of the wood began and 50% acid was the optimum concentration for delignification. It was not considered to generate the Caros acid in concentrated sulfuric acid, then dilute, and use the diluted solution for delignification of lignocellulosics.

SUMMARY OF THE INVENTION

Lignocellulosics, such as straw, wood and wood in various forms of separation or preparation such as fiberized wood, wood meal or destructured wood chips can be effectively, and when desired almost totally, delignified by monoperoxysulfuric acid ($H_2SO_5$ or Caros acid) in strongly acidic solutions having pH less than two. Although the delignifying solutions are strongly acidic, pulp with good strength properties can be obtained.

In the oxidative reaction of $H_2SO_5$ with lignin in lignocellulosics to alter the lignin or to delignify the lignocellulosic material, to yield a cellulose enriched pulp, comparatively very little oxidant is used. This opens the path for treatment of fiberized wood, high yield pulps, wastepapers, recycled papers and the like to enhance their properties and thus utilization, and further opens the door to an economical method for delignifying lignocellulosics from agricultural and forest residues to enhance the enzyme digestibility of the residues.

DETAILED DESCRIPTION OF THE INVENTION

Figure 1:
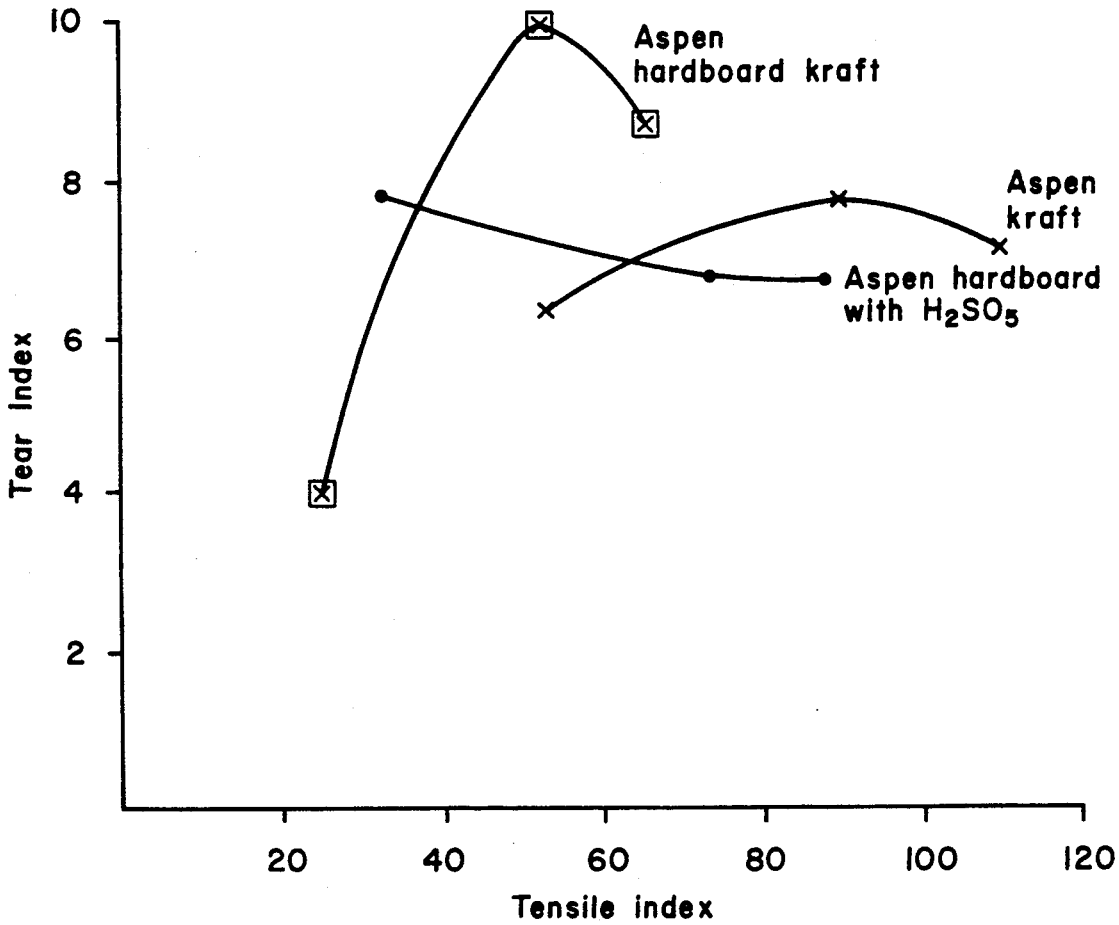
FIG. 1 pulp properties comparison of $HSO_5$ treated hardboard fiber, aspen kraft pulp, and aspen hardboard fiber kraft pulp.

In the preferred embodiment of this invention lignin is removed from lignocellulosics using an aqueous delignifying solution of monoperoxysulfuric acid of the composition listed below under A. A broader range of embodiment is listed under B.

| A. Preferred Embodiment | B. Range of Embodiment |
|---|---|
| pH: −0.1 to 1.8 | −0.3 to 1.99 |
| % $H_2SO_4$ in solution to give pH range 11–0.16 | 20–0.1 |
| Weight % of $HSO_5$ in solution: 0.5–9 | 0.1–20 |
| liquor to wood: 10:1 to 25:1 | 1:1 to 50:1 |
| Time: 0.5–290 hours | 0.1 to 600 |
| Temp.: 20° C.–50° C. | 0° C. to 200° C. |

All types of lignocellulosic materials can be delignified by this method. Lignin can be removed from both light weight and dense hardwoods and softwoods and from all kinds of non-woody species. Illustrative of these non-woody materials are grasses, cereal straws, bamboo, cornstalks, sugar cane bagasse, kenaf, hemp, jute, sisal, esparto, reeds and the like.

If wood is the lignocellulosic to be delignified it is preferable to use fiber, wood meal or destructured wood. Wood chips are not easily penetrated by aqueous acidic solutions and oxidizing agents produce a topochemical effect with chips because the oxidant is consumed by lignin as it moves from the outside fibers inward. Wood chips, however, may be employed under conditions in which the outer treated fibers are separated from the chips and liquors during the digestion period.

PRODUCTION OF MONOPEROXYSULFURIC ACID $H_2SO_5$ (Caros acid) can be produced by the reaction of concentrated sulfuric acid and hydrogen peroxide at low temperatures. To achieve adequate concentrations of $H_2SO_5$ in solution it is necessary to react molar excesses of concentrated sulfuric acid with concentrated hydrogen peroxide. Some conditions for generation of $H_2SO_5$ are given in Table 1; $H_2SO_5$ in solution was determined by the method of Greenspan and Mackellar, Anal. Chem. 20(11): 1061(1948). For use, the $H_2SO_5$ solutions are diluted to the desired concentration. The acid oxidant can also be prepared by the reaction of salts of peroxydisulfuric acid with sulfuric acid as described in Khim. Drev. (Riga) 9: 109-117 (1971) or using the commercially available triple salt containing potassium peroxymonosulfate, the salt having the formula 2 $KHSO_5.KHSO_4.K_2SO_4$, and sulfuric acid as described in U.S. Pat. Nos. 4,404,061 and 4,475,904. The triple salt is produced by the E. I. DuPont Corporation and sold under the name "OXONE", a registered trademark.

TABLE 1

Production of monoperoxysulfuric acid by mixing hydrogen peroxide and concentrated sulfuric acid at ice bath temperature

| Procedure | Concentration of $H_2O_2$, % | Weight of $H_2O_2$ solution added, g | Weight of conc. $H_2SO_4$ added, g | $H_2SO_4$:$H_2O_2$ (mole:mole) | Yield of $H_2SO_5$, % ($H_2O_2$ basis) |
|---|---|---|---|---|---|
| 1 | 32 | 14.2 | 12.7 | 1:1 | 8 |
| 2 | 50 | 17.9 | 55.1 | 1.5:1 | 60 |
| 3 | 70 | 6.9 | 27.5 | 1.9:1 | 78 |

PREPARATION OF LIGNOCELLULOSIC MATERIALS

Wood Meal or Straw Meal

Aspen wood or oat straw was reduced to pass a number 40 mesh screen using a Wiley mill.

Three methods were employed to obtain defibered or destructured wood for subsequent treatment with monoperoxysulfate.

Cold Soda Pulps

Aspen chips, ½ inch (1.27 cm) in length, were covered with a 50 g/l solution of sodium hydroxide and then pressurized to 150 psig (1033.5 kPa) with nitrogen. The chips were held under pressure at room temperature for 1.0 hour. A 6:1 liquor to wood ratio was used. The liquor was then drained from the chips and the chips defibered in an 8-inch (20.32 cm) diameter Bauer disc refiner. An approximately 50:1 ratio of cold water to chips was employed and the discs were set 0.020 inches (0.051 cm) apart. The defibered pulp was run through the refiner a second time using the same conditions. The pulp was then washed twice with cold water, pressed and shredded. Shredded pulp was used in the experiments.

Hardboard Fibers

Fibers used in commercial production of medium density aspen hardboard were obtained from a commercial source. The wood mix was 80% aspen and 20% mixed northern hardwoods. The wood had been chipped and passed through a Bauer double disk pressurized refiner at 120 psig (827 kPa) steam pressure (177° C.). The fiberized wood was discharged through a flash drier, which raised the solids content to 94%, before shipping to the Forest Products Laboratory. The fiber mixture, which contained a considerable amount of fines, was thoroughly washed and wet screened through an 8 slot per inch (2.54 cm) screen. The screened pulp was pressed to remove excess water. The resultant fiber mat was shredded and air dried.

A red oak hardboard fiber was produced using a modified KRIMA refiner. Northern red oak chips, ½ inch (1.27 cm) in length, were presteamed for 5 min. at 150° C. before refining under 65 psig (447.85 kPa) steam pressure (155° C.) in the KRIMA refiner with plate clearance of 0.005 inch (0.0127 cm). The fiber was washed, screened, pressed, shredded and dried as was the aspen-mixed hardwoods fiber.

Destructured Wood

A fresh aspen log was debarked and the center section was sawn into 9 cm lengths and quartered. The wood chunks were then pressed radially at 10,335 kPa. The pressed wood was broken into smaller pieces which were re-pressed until well destructured pieces were obtained.

Treatment with Monoperoxysulfate

Two sources of monoperoxysulfate were used in the following examples: (1) the triple salt OXONE (2 $KHSO_5.KHSO_4.K_2SO_4$), which contained 4.5% active oxygen and (2) monoperoxysulfuric acid (Caro's acid) produced by mixing concentrated hydrogen peroxide and concentrated sulfuric acid. The concentrated mixture of monoperoxysulfate anion in sulfuric acid was diluted to the desired concentration just prior to use. The starting lignocellulosic substrate was mixed with the acidic peracid in a beaker of appropriate volume and placed in a thermostatted water bath or held at room temperature (approximately 25° C.) for the desired length of time. The pulp was stirred intermittently to release gas bubbles and encourage diffusion. At the end of the reaction, the residue was filtered and thoroughly washed. During the wash, the fiber color changed from yellow-orange through yellow and brown to a light tan. The washed pulp was then mixed with a solution of 1% sodium hydroxide, 21 per 110 g of substrate, and heated at 50° C. for 1 to 3 hrs. The alkaline extraction liquors were very dark in color. The pulp was washed with distilled water until the rinse was colorless. Pulp properties such as strength, Kappa number and viscosity were determined using standard methods of the Technical Association of the Pulp and Paper Industry, familiar to one skilled in the art.

Determiniation of Enzymatic Digestibility

The susceptibility of untreated and treated lignocellulose to digestion by cellulase enzyme was determined by incubating 0.2 g of dried sample in 4 ml of a solution containing 50 mM of citric acid, 0.1M $NaHPO_4$, 0.05% thymol and 40 mg. *Trichoderma reesei* cellulase (pH 4.5) for 24 hrs at 45° C. Residual solids in the liquor were removed by centrifugation and the total glucose present in solution was determined by analyzing an aliquot of the liquor for glucose using a Beckman Glucose Analyzer 2 equipped with an oxygen sensitive electrode. The total potential glucose in the undigested sample was determined by standard two stage acid hydrolysis of the sample to completely solubilize, and hydrolyse to monomeric sugars, all of the carbohydrates present. The quantity of glucose as well as other sugars was then determined by high-performance liquid chromatography (HPLC). Correction was made for glucose losses during the two stage hydrolysis. Enzymatic digestibility was defined to be the quotient of the measured glucose in the liquor after cellulase digestion divided by the total potential glucose in the untreated sample multiplied by 100.

Examples of delignification with monoperoxysulfate are given below:

EXAMPLE 1

Aspen Meal, 1.0 gram of air dried wood which passed through a 40 mesh screen, was mixed at room temperature with 25 grams of a solution having 3.3 grams of the solution prepared by Procedure 3 of Table 1. The $HSO_5^-$ concentration in solution was 4.9% and the pH O. The mixture of wood and liquor was kept at room temperature for 24 hours and filtered. The solid residue was heated at 50° C. with 50 ml 1% NaOH for 3 hours, filtered and the residue washed with water until neutral. The yield of solid residue was 60% with 0.4% lignin in the residue. The TAPPI viscosity of the residue was 11 cP (centipoise).

EXAMPLE 2

Aspen meal was delignified by a solution having the same $HSO_5^-$ concentration and liquor to wood ratio as in Example 1, but prepared from OXONE (the 2 $KHSO_5.KHSO_4.K_2SO_4$ triple salt) and having a pH of 1.6. The results of this run were roughly equivalent to Example 1 giving, after alkaline extraction and washing, a residue yield of 63% with 2.8% lignin in the residue. The difference in results from Example 1 was probably due to the reduced acidity in this example as evidenced by the residue having a TAPPI viscosity of 27 cP.

EXAMPLE 3

Aspen-mixed hardwoods (80-20) hardboard fiber (266 g) containing 110 g of ovendry fiber was mixed with 1950 g of an aqueous solution containing 4.6% monoperoxysulfate anion. The aspen hardboard fiber was produced by heating aspen chips for 3 minutes with steam at 177° C. and then defibering them by passing them through a pressurized double disc refiner. The monoperoxysulfuric acid solution was prepared by dropwise addition of 263 g of cold (5° C.) 97% sulfuric acid to 67 g of cold (5° C.) 70% hydrogen peroxide, keeping the temperature of the mixture below 15° C. at all times. A 290 g portion of this mixture was added to 1660 g of distilled water to obtain the solution used. The solution pH was −0.1. The mixture of fiber and solution was heated to 50° C. and maintained at that temperature, with intermittent stirring, for 2 hours. The solution was then drained from the fiber and the fiber washed with distilled water and subsequently extracted with a 1% solution of sodium hydroxide at 50° C. for 1 hour. The fiber was again washed with distilled water, drained and samples taken for Kappa number and yield determinations. It was then made into handsheets for strength testing. The test results were as follows:

| | |
|---|---|
| Pulp Yield, % | 61 |
| Kappa Number | 29 |
| Strength data at 300 ml CSF | |
| Tensile Strength, N.m/g | 87 |
| Tear Strength, mN.M$^2$/g | 6.1 |

EXAMPLE 4

Aspen-mixed hardwoods hardboard fiber (266 g) containing 110 g of ovendry fiber was mixed with 1950 g of an aqueous solution containing 2.6% monoperoxysulfate anion. The fiber was produced as in Example 3. The monoperoxysulfuric acid solution was prepared by dropwise addition of 40 g of cold (5° C.) 70% hydrogen peroxide to 160 g of cold (5° C.) 97% sulfuric acid, keeping the temperature of the mixture below 15° C. at all times. A 160 g portion of this mixture was added to 1790 g of distilled water to obtain the solution used. The solution pH was 0.2. The mixture of fiber and solution was heated to 50° C. and maintained at that temperature, with intermittent stirring, for 2 hours. The fiber was then washed, extracted, sampled and made into handsheets as in Example 3. A sample of the spent treating solution, drained from the treated fiber, was analyzed for monoperoxysulfuric acid. Only 33% of the original monoperoxysulfuric acid had been consumed in the treatment. The test results were as follows:

| | |
|---|---|
| Pulp Yield, % | 84 |
| Kappa Number | 73 |
| Strength data at 340 ml CSF: | |
| Tensile Strength, N.m/g | 78 |
| Tear Strength, mN.M$^2$/g | 5.5 |

EXAMPLE 5

Aspen-mixed hardwoods hardboard fiber (120 g) containing 102 g of ovendry fiber was mixed with 1824 g of an aqueous solution containing 3.1% monoperoxysulfate anion. The pH of the solution had been raised to 0.9 by adding potassium hydroxide. The fiber was produced as in Example 3. The monoperoxysulfuric acid solution was prepared as in Example 4 except that 159 g of the concentrated mixture was added to 1247 g of distilled water and then 58 g of potassium hydroxide dissolved in 400 g of distilled water was added to the solution to raise the pH to 0.9. A 40 g aliquot of the total solution was then taken for analysis and the remainder added to the fiber. The mixture of fiber and solution was heated to 50° C. and maintained at that temperature, with intermittent stirring, for 2 hours. The fiber was then processed as in Example 3. A sample of the spent treating solution was analyzed for monoperoxysulfuric acid; 79% of the original acid had been consumed in the treatment. The test results were as follows:

| | |
|---|---|
| Pulp Yield, % | 80 |
| Kappa Number | 78 |
| Strength data at 300 ml CSF: | |
| Tensile Strength, N.m/g | 73 |
| Tear Strength, nM.m$^2$/g | 5.9 |

EXAMPLE 6

The exact conditions of Example 5 were duplicated except that the mixture of fiber and treating solution was held for 24 hours at room temperature (25° C.) instead of for 2 hours at 50° C. The treatment consumed 60% of the original monoperoxysulfuric acid. Test results were as follows:

| | |
|---|---|
| Pulp Yield, % | 65 |
| Kappa Number | 43 |
| Strength data at 370 ml CSF: | |
| Tensile Strength, N.m/g | 87 |

-continued

| | |
|---|---|
| Tear Strength, nM.m$^2$/g | 6.7 |

EXAMPLE 7

Aspen-mixed hardwoods hardboard fiber (120 g) containing 102 g of ovendry fiber was mixed with 1824 g of an aqueous solution containing 3.0% monoperoxysulfate anion. The fiber was produced as in Example 3. The monoperoxysulfuric acid solution was prepared as in Example 4 except that 159 g of the concentrated mixture was added to 1705 g of distilled water. No potassium hydroxide was added. The solution pH was 0.2. A 40 g aliquot of the solution was taken for analysis and the remainder added to the fiber. The mixture of fiber and treating solution was held for 24 hours at room temperature (25° C.). It was stirred several times during this period. The fiber was then washed, extracted, sampled and made into handsheets as in Example 3. A sample of the spent treating solution was analyzed for monoperoxysulfuric acid; 71% of the original peroxyacid had been consumed. The test results were as follows:

| | |
|---|---|
| Pulp Yield, % | 70 |
| Kappa Number | 37 |
| Strength data at 300 CSF: | |
| Tensile Strength, N.m/g | 90 |
| Tear Strength, mN.m$^2$/g | 6.5 |

EXAMPLE 8

The exact conditions of Example 7 were duplicated except that the mixture of fiber and treating solution were held for 48 hours at room temperature (25° C.) instead of for 24 hours. The treatment consumed 84% of the original monoperoxysulfuric acid. Test results were as follows:

| | |
|---|---|
| Pulp Yield, % | 65 |
| Kappa Number | 20 |
| Strength data at 300 ml CSF: | |
| Tensile Strength, N.m/g | 89 |
| Tear Strength, mN.m$^2$/g | 6.3 |

EXAMPLE 9

A bleachable grade chemical pulp was prepared from an aspen cold soda chemimechanical pulp by treatment with OXONE (2 $KHSO_5.KHSO_4.K_2SO_4$). The cold soda pulp was prepared by the pressure impregnation of ½ inch green aspen chips (46.6% solids) with a 50 g/l solution of sodium hydroxide. The chips were soaked for 1 hour at 22° C. under 150 psig nitrogen. The soaked chips were then fiberized by two passes through a disk attrition mill. The fiber was washed, pressed and shredded to give a 91% yield of chemimechanical pulp. The pulping procedure used the following quantities of materials: 363 g cold soda pulp (110 g dry basis), 669 g OXONE (2 $KHSO_5.KHSO_4.K_2SO_4$), 117 ml concentrated sulfuric acid, 1533 ml total water. The pulping solution was at pH 0.1 with 8.9% by weight $HSO_5^-$ anion. The resultant chemical pulp was obtained in 73% yield based on the starting cold soda pulp or 67% based on original wood. The test results on the pulp are given below:

| | |
|---|---|
| Pulp Yield, % | 73 |
| Kappa Number | 11.5 |
| Strength Data at 350 ml CSF: | |
| Tensile Strength, N.m/g | 99 |
| Tear Strength, mN.m$^2$/g | 5.9 |

EXAMPLE 10

A bleachable grade chemical pulp was prepared from aspen-mixed hardwoods hardboard fiber. The pulping solution, the same as in Example 12, was prepared by dissolving 699 g of OXONE (2 $KHSO_5.KHSO_4.K_2SO_4$) in 1533 ml of distilled water. Concentrated sulfuric acid (117 ml) was added carefully with stirring. Aspen-mixed hardwoods fiber, 113.4 g (110 g oven dry) prepared as in Example 3, was thoroughly mixed with the pulping solution. The pulp suspension was then maintained at 50° C. in a water bath for 2 hours with intermittent stirring. The pulp was washed and the oxidized lignin fragments were extracted with 1% sodium hydroxide solution and washed as in Example 3. Test results are given below:

| | |
|---|---|
| Pulp Yield, % | 57 |
| Kappa Number | 10.5 |
| Strength Data at 300 ml CSF: | |
| Tensile Strength, N.m/g | 88 |
| Tear Strength, mN.m$^2$/g | 6.4 |

EXAMPLE 11

Oat straw, 1.08 g, ground in a Wiley mill to pass through a No. 40 mesh screen, which contained 0.99 g of oven dry substance, was mixed with 25.0 g of an aqueous solution containing 2.4% monoperoxysulfate anion. The monoperoxysulfuric acid solution was prepared by adding 27.5 g of 97% sulfuric acid at 22° C. to 6.9 g of 70% hydrogen peroxide at 2° C. in a glass vial in an ice bath and thoroughly mixing. A 1.7 g portion of this mixture was added to 23.3 g of distilled water to obtain the solution used. The pH of the solution was 0.3. The mixture of straw and solution was held at room temperature (22° C.) for 24 hours and was mixed several times during this period. The solution was then drained from the straw residue and the residue was washed with distilled water and subsequently extracted with a 1% solution of sodium hydroxide at 50° C. for 3 hours. The residue was again washed with distilled water, drained and air dried. It was then dried in a vacuum oven at 60° C. for 16 hours. After treatment, 69% of the original monoperoxysulfuric acid remained in the solution. The yield of residue was 58%. It's lignin content was 5%; the original straw contained 16% lignin. The treatment increased the enzymatic digestibility (*Trichoderma reesei* cellulase) of the straw (based on total potential glucose) from 33% to 90%.

EXAMPLE 12

Oat straw, 3.26 g, ground as in Example 11, which contained 3.00 g of oven dry substance, was mixed with 30.0 g of an aqueous solution containing 0.58% monoperoxysulfate anion. The monoperoxysulfuric acid solution was prepared by dropwise addition of 40.3 g of cold (5° C.) 70% hydrogen peroxide to 159.7 g of cold (5° C.) 97% sulfuric acid, keeping the mixture below 15° C. at all times. A 0.50 g portion of this mixture was added to 29.50 g of distilled water to obtain the solution used. The solution pH was 0.8. The mixture of straw and solution was held at room temperature (22° C.) for 24 hours and mixed several times during this period. The solution was then drained from the straw residue and the residue washed, extracted with 1% sodium hydroxide, washed again and dried as in Example 11. After the treatment, 17% of the original monoperoxysulfuric acid remained unconsumed. The yield of residue was 66%. It's lignin content was 10%; the original straw contained 16% lignin. The treatment increased the enzymatic digestibility of the straw from 33% to 74%.

The above examples show that delignification of lignocellulosics is achievable over a broad range of lignocellulosics and a broad range of delignification conditions under strongly acidic conditions with pH less than two using monoperoxysulfuric acid. FIG. 1 illustrates pulp properties of tensile and tear index for hardboard fibers delignified by $H_2SO_5$ (Example 6) and kraft pulping and an aspen kraft pulp from wood chips. The aspen hardboard kraft develops high tear strength indicating that inherent fiber strength was retained through the refining process. However, the hardboard kraft pulp did not develop high bonding as indicated by the tensile index values. Delignification of the hardboard fiber with acidic $HSO_5^-$ anion resulted in a pulp with properties roughly approaching aspen kraft pulp from chips. Relative to kraft pulp, papers made from monoperoxysulfate pulps are well bonded but have lower tear strengths. Brighter pulps than kraft can be produced, with about the same opacity. Zero-span tensile strengths of the monoperoxysulfate pulps are comparable to those of kraft pulped hardboard fiber, but are lower than those of kraft pulps from chips.

Figure 2:
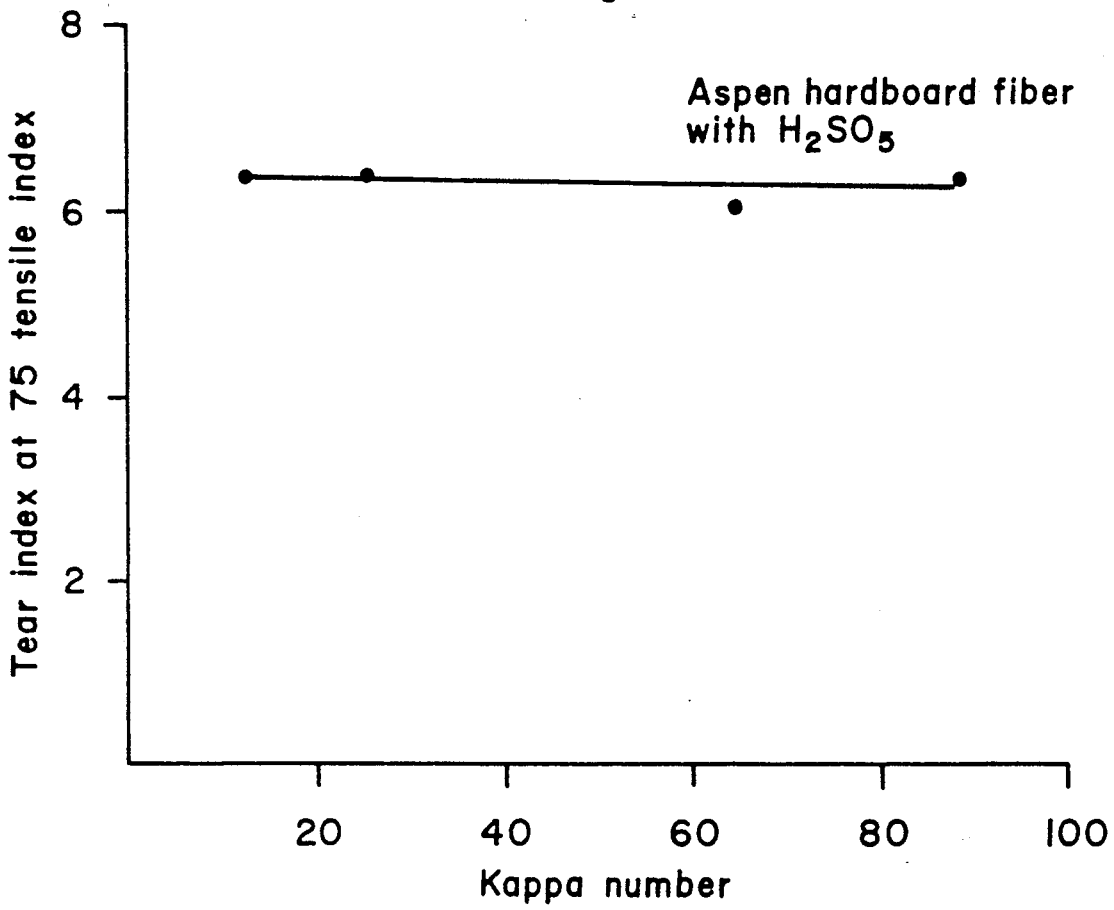
FIG. 2 change in strength property with delignification for $HSO_5$ treated hardboard fiber.

The change in strength properties with changes in the extent of delignification of the hardboard fibers by monoperoxysulfate is shown in FIG. 2. In contrast with other chemical pulping processes such as kraft, there is not a large change in handsheet strength properties as the pulp is delignified. This may be because of a concurrent weakening of the fibers as delignification progresses, but another factor is the higher selectivity of lignin removal of the monoperoxysulfate process relative to kraft. The higher weight yield of each fiber means that a higher load is being carried by each fiber in strength tests at constant basis weight. The results imply that, except for applications requiring fully bleached pulp, high yield monoperoxysulfate pulps should be as suitable as those of lower yield.

Figure 3:
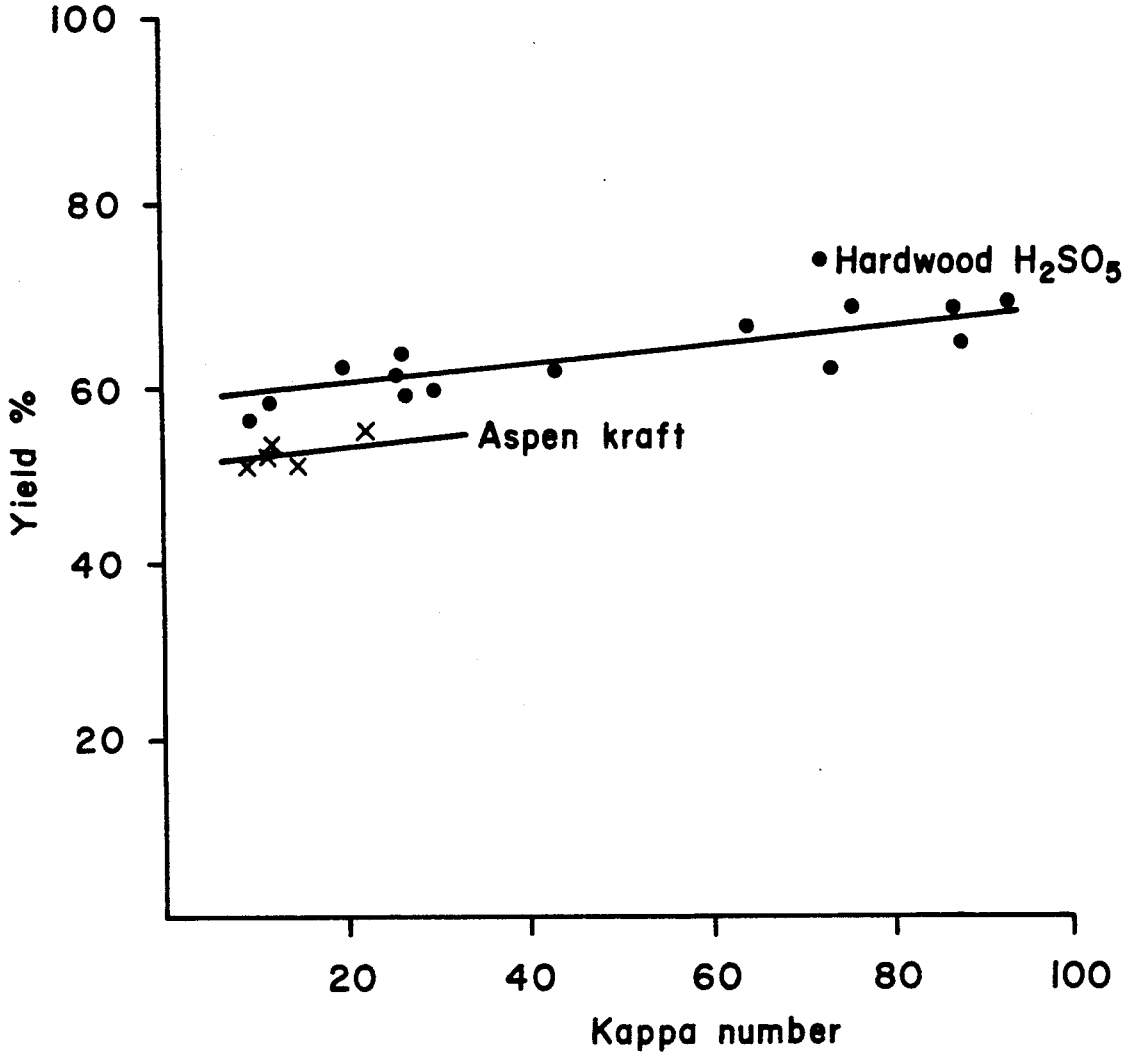
FIG. 3 comparison of pulp yield and lignin content for hardboard fiber treated with $HSO_5$ and aspen kraft pulp.

The selectivity of the monoperoxysulfate method is demonstrated by the yield vs Kappa number curves shown in FIG. 3. Regardless of the conditions used, there is a reasonably straight line relationship between the yield loss and the extent of delignification. The higher yields at any given Kappa number for the monoperoxysulfate method compared with those obtained by kraft pulping show the greater pulping selectivity of the process. This is similar to other oxidative pulping processes such as those using oxygen or chlorine dioxide.

We claim:

1. A method of fractionating lignocellulosics by oxidative alteration of the lignin component followed by its extraction, the lignocellulosics being defiberized, destructured or ground prior to treatment, the method comprising:

(a) treating the lignocellulosic with an acidic oxidative aqueous solution having a pH range of 0 to 1.8, a sulfuric acid weight concentration of 0.16% to 11% based on solution, a monoperoxysulfuric acid weight concentration of 0.5% to 9% based on solution, at a temperature of up to 100° C. for a time period of up to 290 hours and a solution to wood ratio of 1:1–25:1, to form a lignocellusic residue;

(b) separating the lignocellulosic residue from the solution;

(c) extracting the lignin from the lignocellulosic residue.

2. A method as recited in claim 1 wherein the lignin extraction is carried out by dilute alkali solution.

* * * * *